US007506935B1

(12) United States Patent
Lin

(10) Patent No.: US 7,506,935 B1
(45) Date of Patent: Mar. 24, 2009

(54) ADJUSTMENT MEANS FOR BACKREST

(75) Inventor: Yu-Hong Lin, Min Hsiung Township, Chayi County (TW)

(73) Assignee: Tung Yu Oa Co., Ltd., Min Hsiung Township, Chayi County (TW)

( * ) Notice: Subject to any disclaimer, the term of this patent is extended or adjusted under 35 U.S.C. 154(b) by 0 days.

(21) Appl. No.: 12/104,502

(22) Filed: Apr. 17, 2008

(51) Int. Cl.
*B60N 2/02* (2006.01)

(52) U.S. Cl. ..... 297/383; 297/353

(58) Field of Classification Search ..... 297/353, 297/383

See application file for complete search history.

(56) References Cited

U.S. PATENT DOCUMENTS 360,855 A * 4/1887 Cooper ..... 297/383
3,720,442 A * 3/1973 Bergmann et al. ..... 297/344.18
5,405,189 A * 4/1995 Stumpf ..... 297/353
6,095,606 A * 8/2000 Opsvik ..... 297/340
6,619,745 B2 * 9/2003 Roberts et al. ..... 297/383
7,264,312 B1 9/2007 Wang ..... 297/353
2007/0040428 A1 * 2/2007 Sakumoto ..... 297/250.1

* cited by examiner

*Primary Examiner*—Milton Nelson, Jr.
(74) *Attorney, Agent, or Firm*—Alan Kamrath; Kamrath & Associates PA

(57) ABSTRACT

An adjustment device includes a seat brace including lower and upper support plates fixed thereon, respectively. A back brace includes a second end tightly disposed between the lower and upper support plates of the seat brace, with friction generated between the lower and upper support plates and the second end of the back brace, respectively. A locating portion is defined on the second end of the back brace. An adjustment unit includes an end pivotally connected to the seat brace and another end opposite to the actuated element and exposed outside of the adjustment device for use. An actuated element is mounted on the adjustment unit relative to the locating portion and connected to the locating portion.

19 Claims, 5 Drawing Sheets

ADJUSTMENT MEANS FOR BACKREST

BACKGROUND OF THE INVENTION

1. Field of the Invention

The present invention relates to an adjustment means for a backrest. In particular, the adjustment means can be operated with a single hand and reduces harm to users during adjustment of positions of the backrest.

2. Description of the Related Art

Referring to U.S. Pat. No. 7,264,312, a conventional chair includes a backrest adjusting mechanism for changing the distance and height of a backrest relative to a seat of a chair at the same time. However, while a user is sitting on the chair and wants to adjust the position of the backrest relative to the seat, he or she has to operate a L-shaped locating gear with his or her hand and push the backrest with his or her back simultaneously. Hence, adjustment of the position of the backrest relative to the seat of said chair with a user's single-hand is unachievable.

The present invention is therefore intended to obviate or at least alleviate the problems encountered in the prior art.

SUMMARY OF THE INVENTION

Accordingly, the objective is achieved by providing an adjustment means for an office chair that includes a seat brace, a back brace installed to the seat brace and an adjustment unit disposed between the seat and back braces. The seat brace includes lower and upper support plates. The back brace includes a second end tightly disposed between the lower and upper support plates of the seat brace to prevent free movement of the second end between the lower and upper support plates. Users operate the adjustment unit to drive the back brace to move with respect to the seat brace.

The primary advantage of the adjustment means according to the present invention is that users can operate the adjustment means with a single hand and without utilizing further outside force to pull or push the back of chair for adjusting the back of chair frontward or rearward with respect to the seat of chair.

Other objectives, advantages, and features of the invention will become more apparent from the following detailed description when taken in conjunction with the accompanying drawings.

BRIEF DESCRIPTION OF THE DRAWINGS

The structure and the technical means adopted by the present invention to achieve the above and other objectives can be best understood by referring to the following detailed description of the preferred embodiments and the accompanying drawings, wherein.

DETAILED DESCRIPTION OF THE PREFERRED EMBODIMENT

Figure 1:
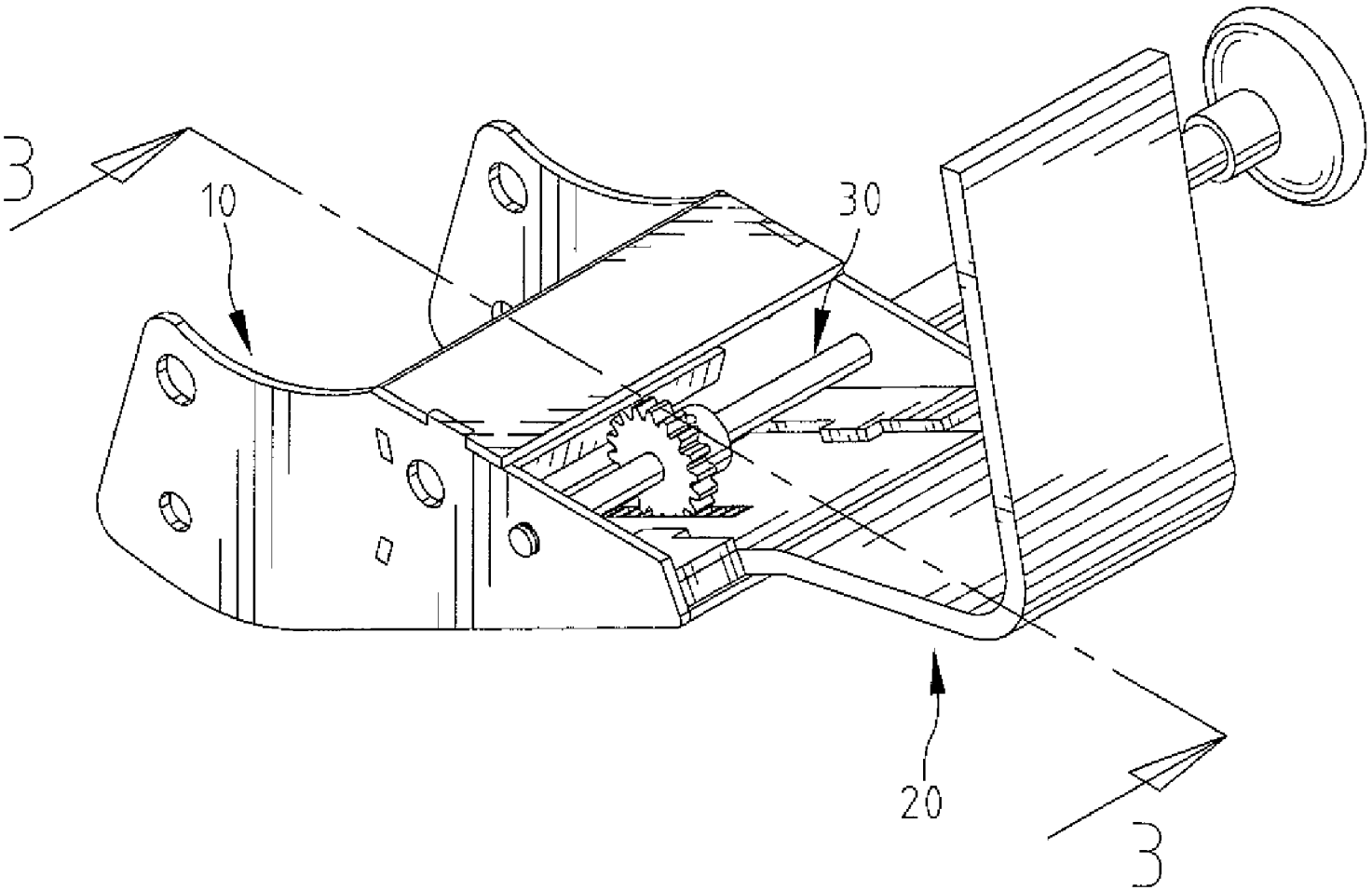
FIG. 1 is a perspective view of an adjustment means for a backrest according to the present invention.
Figure 2:
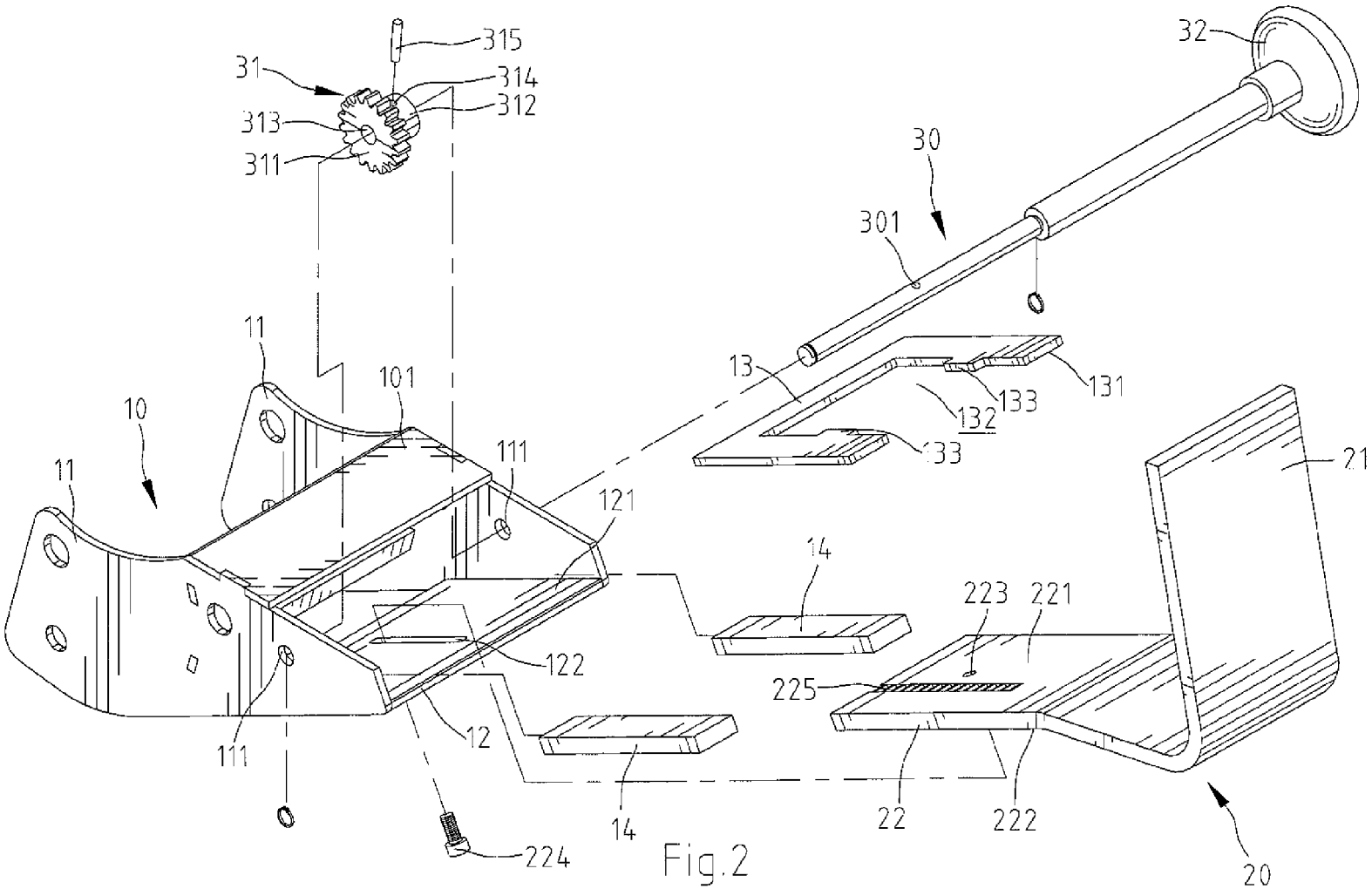
FIG. 2 is an exploded view of the adjustment means shown in FIG. 1.

Referring to the drawings, an adjustment means for a backrest in accordance with the preferred embodiment in the present invention includes a seat brace 10, a back brace 20 installed to the seat brace 10 and an adjustment unit 30 disposed between the seat and back braces 10 and 20. The back brace 20 can be driven via operation of the adjustment unit 30, and then, moves with respect to the seat brace 10.

Figure 5:
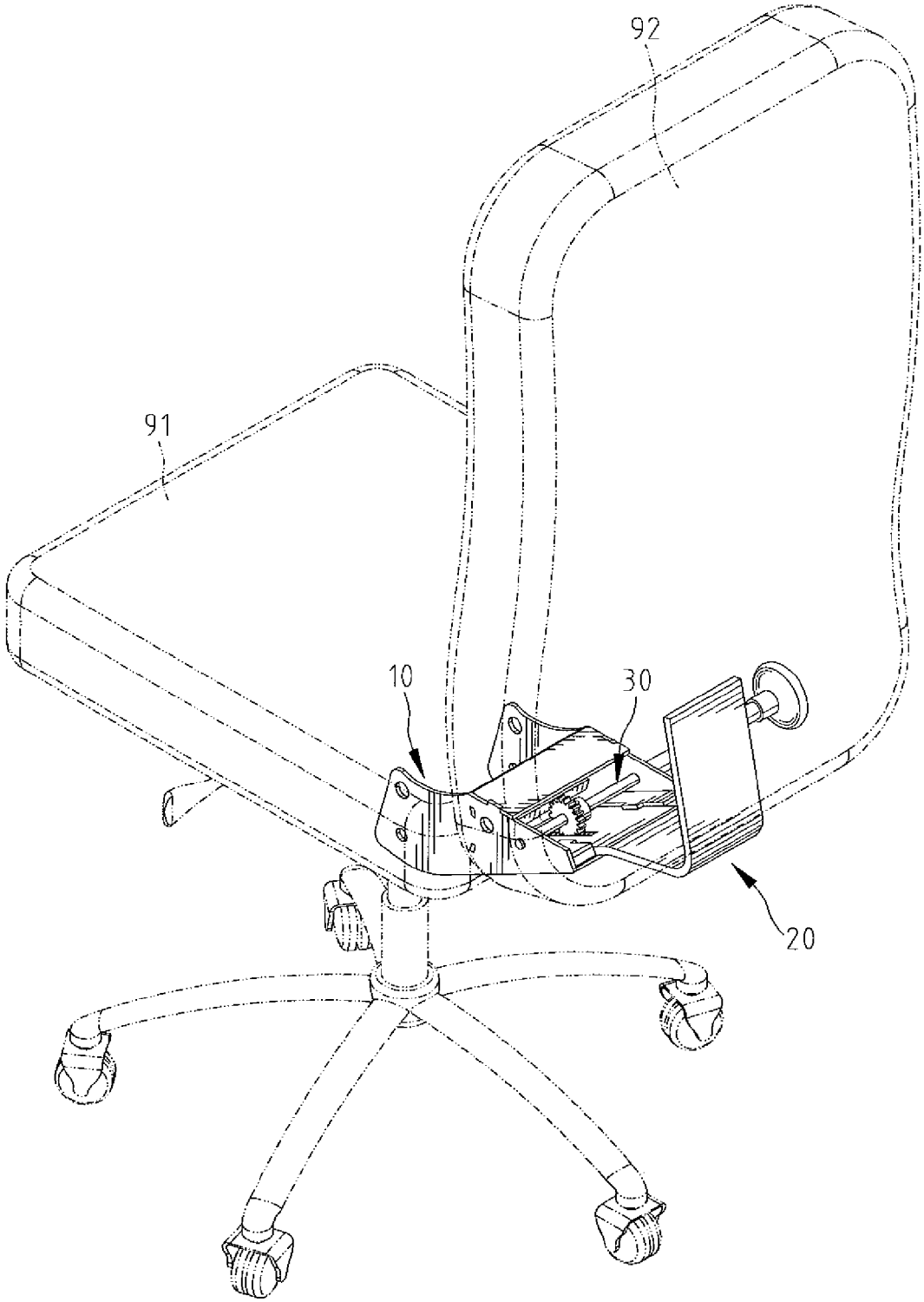
FIG. 5 is a perspective view of the adjustment means that is shown in FIG. 1 installed to the seat and the back of an office chair.

Particularly referring to FIG. 5, the seat brace 10, which is provided on the bottom of a seat 91 of an office chair (not numbered) and adjoins a back 92 of the office chair, includes two lateral walls 11, a lower support plate 12 and an upper support plate 13. The lateral walls 11 are parallel to each other, and a space (not numbered) is defined therebetween. The lower support plate 12 is connected to the bottom of the lateral walls 11 respectively and below the space. The upper support plate 13 is connected to the inner side of the lateral walls 11 respectively and provided in the space. An upper surface 121 and a lower surface 131 are defined on the lower and upper support plates 12 and 13, respectively, and parallel to and spaced from each other. At least one cushion blocks 14 are disposed between the lower and upper support plates 12 and 13 and allow maintaining the distance from the lower support plate 12 to the upper support plate 13.

A top plate 101 is provided on the top edge of the lateral walls 11 respectively and above the space. In this embodiment, the top plate 101 is parallel to the bottom of the seat 91. The upper surface 121 of the lower support plate 12 is angled at 25-35 degrees to the top plate 101, and equally the lower surface 131 of the upper support plate 13 is angled at 25-35 degrees to the top plate 101. A limited slot 122 is defined on the lower support plate 12 longitudinally.

The upper support plate 13 is preferably in a form of a U-shaped plate and includes a yawn 132. Two projections 133 are formed on two sides of the upper support plate 13 and extend toward the inside of the yawn 132, respectively.

The back brace 20 is approximately L-shaped and includes a first end 21 and a second end 22 bent to the first end 21. The first end 21 is adapted for assembly with the seat 92 (as shown in FIG. 5). The second end 22 is installed between the lower and upper support plates 12 and 13 of the seat brace 10 for tight assembly of the seat and back braces 10 and 20. A top side 221 and a bottom side 222 are defined on the second end 22 and are parallel to each other. A thickness of the second end 22 is equal to the distance between the top and bottom sides 221 and 222 and also equal to the distance between the upper and lower surfaces 121 and 131. Accordingly, it will increase face friction between the lower and upper support plates 12, 13 and the second end 22, respectively, and prevent unexpected movement of the second end 22 between the lower and upper support plates 12, 13. Therefore, the back 92 and the back brace 20 will not freely slide on the seat brace 10 without operation of the adjustment unit 30.

A coupled hole 223 is formed on the second end 22 and adapted to couple with a coupled element 224. The coupled element 224 extends through the limited slot 122 of the lower support plate 12 and, then, is coupled to the coupled hole 223 for restricting movement of the back brace 20. In this embodiment, the coupled element 224 has threads. A locating portion 225 is formed on the top side 221 of the second end 22 and longitudinally extends from the edge of the second end 22 toward the first end 21.

The adjustment unit 30 is pivotally installed to the lateral walls 11 of the seat brace 10. Two through holes 111 are defined on the lateral walls 11 respectively. An end of the adjustment unit 30 inserts through the through holes 111 respectively, and another end of the adjustment unit 30 is exposed outside for users to operate.

An actuated element 31 includes an engaged end 311 formed on an end thereof and a connected end 312 opposite to the engaged end 311. A first through-hole 313 longitudinally penetrates the actuated element 31, and two openings of the first through-hole 313 are respectively formed on the engaged and connected ends 311, 312. The first through-hole 313 is adapted for inserting the end of adjustment unit 30 therethrough. A second through-hole 314 axially penetrates the connected end 312 and is perpendicular to the first through-hole 313. A pin 315 is inserted through the second through-hole 314 and a hole 301 that is defined on the end of the adjustment unit 30 for fixing the actuated element 31 to the adjustment unit 30. Furthermore, the actuated element 31 is disposed in the space of the seat brace 10 and inserted through the yawn 132 of the upper support plate 13 so that the engaged end 311 can cooperate with the locating portion 225 of the second end 22. When a user turns the adjustment unit 30, the second end 22 of the back brace 20 is driven to move between the lower and upper support plates 12 and 13 with respect to the seat brace 10 so that the position of the back 92 of the office chair will be adjusted to a desired position. Additionally, when the back brace 20 is driven to move by operation of the adjustment unit 30, movement of the back brace 20 can be upward and rearward simultaneously or downward and frontward simultaneously. The cause of the above-mentioned is the inclined angle between the second end 22 of the back brace 20 and the top plate 101 of the seat brace 10.

The engaged end 311 of the actuated element 31 is preferably in a form of a gear, and the locating portion 225 of the second end 22 is preferably in a form of a row of teeth and engaged with the engaged end 311 of the actuated element 31 so that the second end 22 of the back brace 20 is driven to move with respect to the seat brace 10. A turning handgrip 32 is installed to another end of the adjustment unit 30 opposite to the actuated element 31 for an easy grip by users. The turning handgrip 32 has an outer diameter which is larger than that of the actuated element 31 as to save effect in operation.

Figure 3:
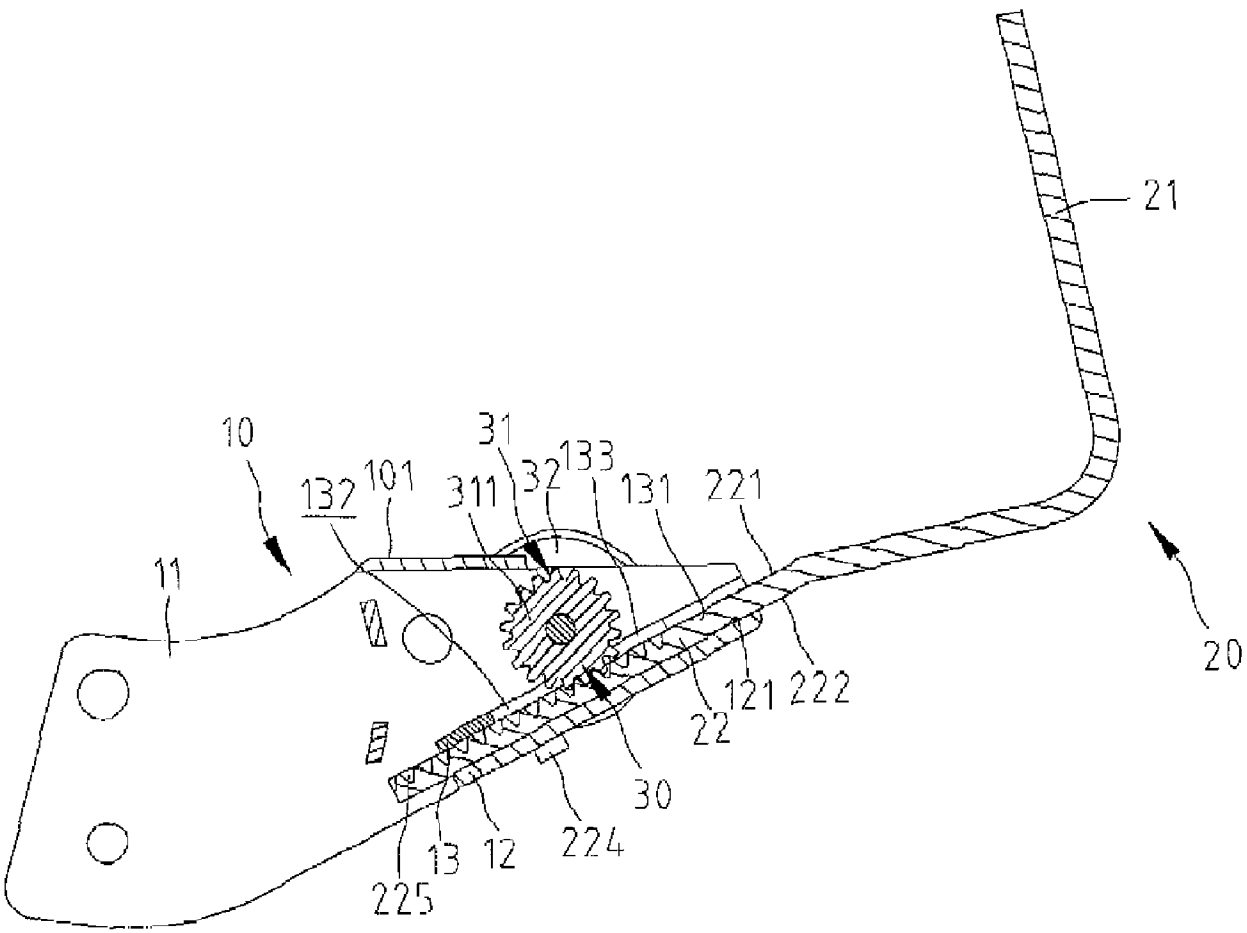
FIG. 3 is a cross-sectional view taken along line 3-3 in FIG. 1.
Figure 4:
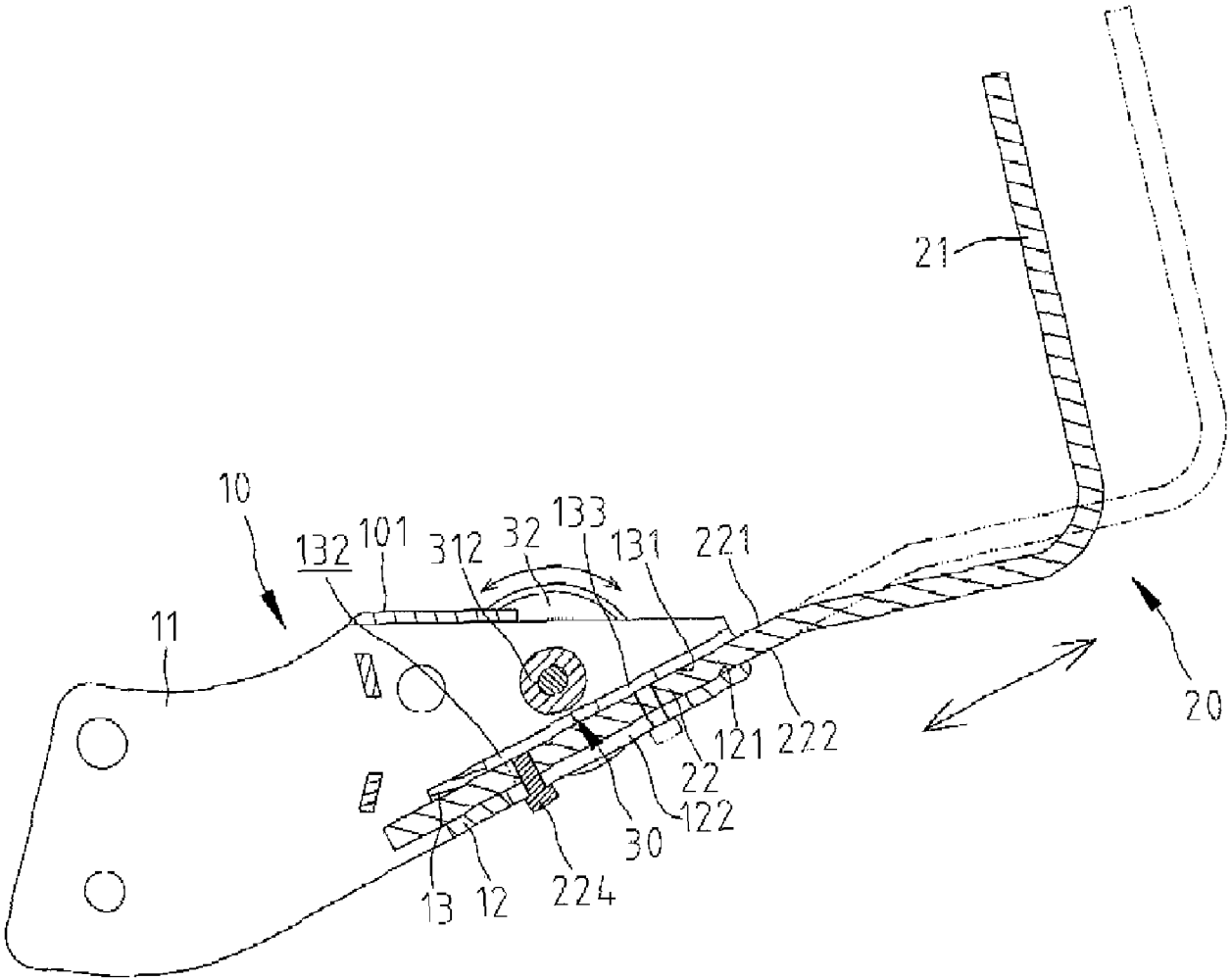
FIG. 4 is another cross-sectional view of the adjustment means shown in FIG. 1, illustrating operating the adjustment means to move the back brace along the limited slot of the seat brace.

Referring to FIGS. 3 and 4, when users turn the turning handgrip 32 to overcome friction between the lower and upper support plates 12, 13 and the second end 22, respectively, the engaged end 311 of the actuated element 31 is operated to drive the locating portion 225 of the second end 22 for movement of the second end 22 between the lower and upper support plates 12, 13. Therefore, users can adjust the back brace 20 frontward or rearward with respect to the seat brace 10 with a single hand.

Furthermore, when the adjustment unit 30 is turned in operation, the back brace 20 is driven to move simultaneously. Accordingly, when the adjustment unit 30 is stopped turning, the back brace 20 will be stopped to a desired position. Therefore, users do not need to further push or pull the back 92 of the office chair using the back or another hand of the user or the like.

What is claimed is:

1. An adjustment means for a chair comprising:

a seat brace including lower and upper support plates fixed thereon, respectively;

a back brace including a second end tightly disposed between the lower and upper support plates of the seat brace, with friction generated between the lower and upper support plates and the second end of the back brace, respectively;

a locating portion defined on the second end of the back brace;

an adjustment unit having an end that is pivotally connected to the seat brace and another end opposite to the seat brace and exposed outside thereof for a user to grip in operation; and an actuated element, with the end of the adjustment unit inserted through the actuated element, with an engaged end formed on the actuated element and in communication with the locating portion;

wherein when the adjustment unit is turned, the engaged end of the actuated element drives the locating portion to move the back brace with respect to the seat brace.

2. The adjustment means as claimed in claim 1 further comprising a coupled element, wherein the lower support plate further comprises a limited slot longitudinally formed thereon; wherein the second end of the back brace further comprises a coupled hole for coupling with the coupled element, with the coupled element inserted through the limited slot and coupled to the coupled hole.

3. The adjustment means as claimed in claim 1, wherein the engaged end of the actuated element is a gear, and the locating portion of the second end has a row of teeth, with the gear engaged with the row of teeth so that the back brace is driven to move with respect to the seat brace.

4. The adjustment means as claimed in claim 3 further comprising a coupled element, wherein the lower support plate further comprises a limited slot longitudinally formed thereon; wherein the second end of the back brace further comprises a coupled hole for coupling with the coupled element, with the coupled element inserted through the limited slot and coupled to the coupled hole.

5. The adjustment means as claimed in claim 1, wherein the actuated element further comprises a connected end formed thereon opposite to the engaged end, with a first through-hole longitudinally penetrating the actuated element with the end of the adjustment unit inserted through the first through-hole, with a second through-hole axially penetrating the connected end and perpendicular to the first through-hole; wherein a pin is inserted through the second through-hole to the end of the adjustment unit for fixing the actuated element to the adjustment unit.

6. The adjustment means as claimed in claim 5, with the adjustment unit having a hole receiving the pin.

7. The adjustment means as claimed in claim 1, further comprising an upper surface defined on the lower support plate and a lower surface defined on the upper support plate, with the upper and lower surfaces spaced from and parallel to each other; wherein the second end of the back brace further comprises top and bottom sides, with the top and bottom sides parallel to each other and defining a width of the second end of the back brace, with the width of the second end of the back brace equal to a distance between the upper and lower surfaces, with the top and bottom sides tightly in contact with the lower and upper surfaces respectively.

8. The adjustment means as claimed in claim 7 further comprising a coupled element, wherein the lower support plate further comprises a limited slot longitudinally formed thereon; wherein the second end of the back brace further comprises a coupled hole for coupling with the coupled element, with the coupled element inserted through the limited slot and coupled to the coupled hole.

9. The adjustment means as claimed in claim 7, further comprising at least one cushion block disposed between the lower and upper support plates.

10. The adjustment means as claimed in claim 9, wherein the engaged end of the actuated element is a gear, and the locating portion of the second end has a row of teeth, with the gear engaged with the row of teeth so that the back brace is driven to move with respect to the seat brace.

11. The adjustment means as claimed in claim 10, further comprising a turning handgrip formed on the other end of the adjustment unit opposite to the actuated element for users to operate, with an outer diameter of the turning handgrip being larger than a diameter of the actuated element.

12. The adjustment means as claimed in claim 7, wherein the upper support plate further comprises a yawn defined thereon and two projections respectively formed on two sides of the upper support plate and extending toward the yawn.

13. The adjustment means as claimed in claim 12, further comprising at least one cushion block disposed between the lower and upper support plates.

14. The adjustment means as claimed in claim 13, wherein the engaged end of the actuated element is a gear, and the locating portion of the second end has a row of teeth, with the gear engaged with the row of teeth so that the back brace is driven to move with respect to the seat brace.

15. The adjustment means as claimed in claim 14, further comprising a turning handgrip formed on the other end of the adjustment unit opposite to the actuated element for users to operate, with an outer diameter of the turning handgrip being larger than a diameter of the actuated element.

16. The adjustment means as claimed in claim 12, wherein the seat brace further comprises two lateral walls and a top plate, with the top plate provided on a top edge of the lateral walls, with the top plate parallel to a bottom surface for a seat of the chair, with the upper surface of the lower support plate being angled at 25-35 degrees to the top plate, with the lower surface of the upper support plate being angled at 25-35 degrees to the top plate.

17. The adjustment means as claimed in claim 16, further comprising at least one cushion block disposed between the lower and upper support plates.

18. The adjustment means as claimed in claim 17, wherein the engaged end of the actuated element is a gear, and the locating portion of the second end has a row of teeth, with the gear engaged with the row of teeth so that the back brace is driven to move with respect to the seat brace.

19. The adjustment means as claimed in claim 18, further comprising a turning handgrip formed on the other end of the adjustment unit opposite to the actuated element for users to operate, with an outer diameter of the turning handgrip being larger than a diameter of the actuated element.

* * * * *